United States Patent [19]

Funayama et al.

[11] Patent Number: 4,980,728

[45] Date of Patent: Dec. 25, 1990

[54] DEVELOPING DEVICE WITH A MAGNETIC BRUSH TURNING PLATE

[75] Inventors: Naotaka Funayama; Masatoshi Kaneshige, both of Nara, Japan

[73] Assignee: Sharp Kabushiki Kaisha, Osaka, Japan

[21] Appl. No.: 237,870

[22] Filed: Aug. 29, 1988

[30] Foreign Application Priority Data

| | | | |
|---|---|---|---|
| Sep. 4, 1987 | [JP] | Japan | 62-222661 |
| Sep. 4, 1987 | [JP] | Japan | 62-222662 |
| Sep. 4, 1987 | [JP] | Japan | 62-222663 |
| Sep. 4, 1987 | [JP] | Japan | 62-222664 |
| Sep. 4, 1987 | [JP] | Japan | 62-222665 |
| Sep. 4, 1987 | [JP] | Japan | 62-222666 |
| Sep. 4, 1987 | [JP] | Japan | 62-135663[U] |
| Sep. 4, 1987 | [JP] | Japan | 62-135664[U] |
| Sep. 4, 1987 | [JP] | Japan | 62-135665[U] |
| Sep. 4, 1987 | [JP] | Japan | 62-135666[U] |

[51] Int. Cl.[5] ..... G03G 15/09; G03G 15/06

[52] U.S. Cl. ..... 355/251; 118/657; 355/245

[58] Field of Search ..... 355/251, 253, 252, 245; 118/656, 657, 658

[56] References Cited

U.S. PATENT DOCUMENTS

| | | | |
|---|---|---|---|
| 4,105,324 | 8/1978 | Seil | 355/208 |
| 4,136,945 | 1/1979 | Stephens | 355/208 |
| 4,240,374 | 12/1980 | Edwards et al. | 118/657 |
| 4,287,850 | 9/1981 | Yamamoto | 355/251 X |
| 4,452,173 | 6/1984 | Tabuchi et al. | 355/251 X |
| 4,766,458 | 8/1988 | Oka et al. | 355/251 X |

FOREIGN PATENT DOCUMENTS

| | | | |
|---|---|---|---|
| 0046334 | 4/1975 | Japan . | |
| 0157768 | 12/1980 | Japan | 355/251 |
| 0054163 | 3/1982 | Japan . | |
| 0041351 | 9/1985 | Japan . | |

*Primary Examiner*—A. T. Grimley
*Assistant Examiner*—Nestor R. Ramirez
*Attorney, Agent, or Firm*—Flehr, Hohbach, Test, Albritton & Herbert

[57] ABSTRACT

A developing device for a copier is comprised of a developer roller having a shaft rotatably supported by its developing tank and a magnet structure affixed to this supporting shaft and having a plurality of magnet poles on its external peripheral surface. An arcuate brush forming plate is disposed between the developer roller and the photoreceptor of the copier. One end of this plate is formed to scrape developing agent attached to the developer roller such that it can be transported onto this brush forming plate.

12 Claims, 9 Drawing Sheets

FIG._19
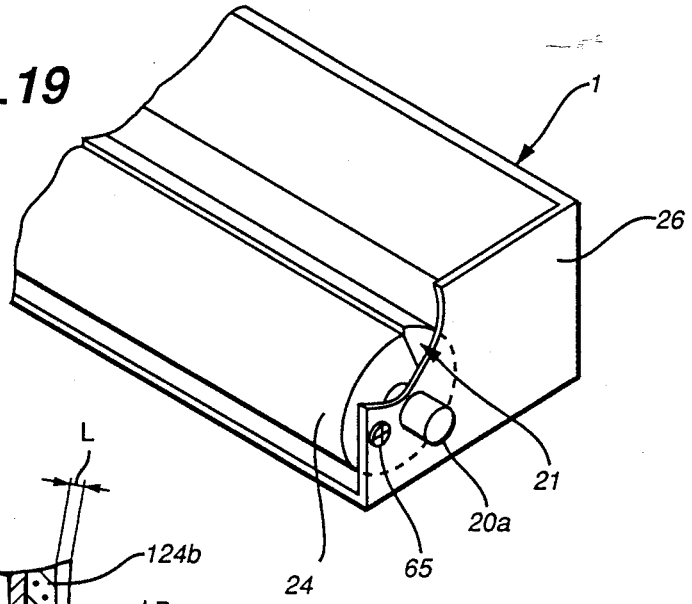
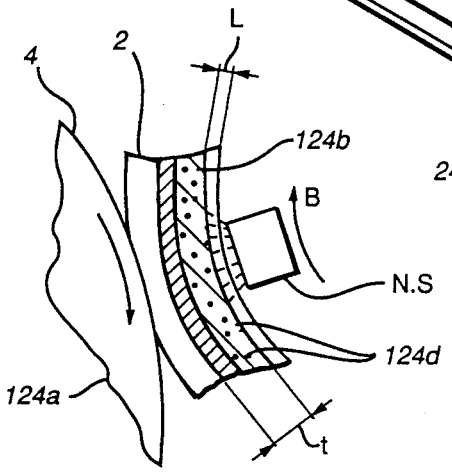
FIG._20
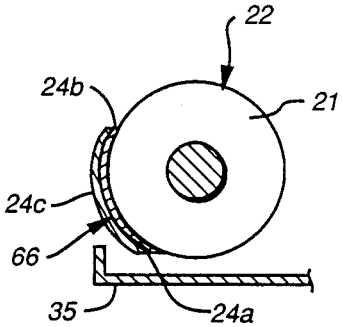
FIG._23
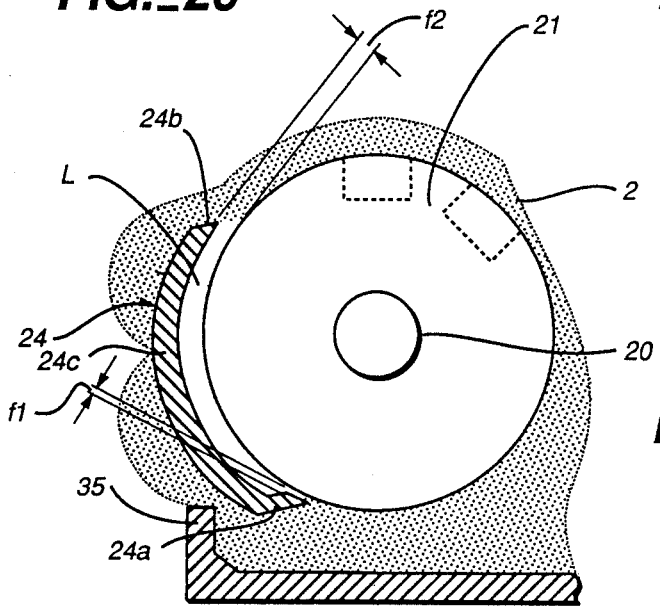
FIG._21

DEVELOPING DEVICE WITH A MAGNETIC BRUSH TURNING PLATE

BACKGROUND OF THE INVENTION

This invention relates to a developing device for an electrophotographic copier for applying developing agent to an electrostatic latent image formed on a photoreceptor by exposure to an image forming beam of light.

In order to explain the background of the present invention clearly, an example of a prior art developing device for an electrophotographic copier with a photoreceptor is shown at A in FIG. 1 with its developing tank 1 provided with a stirrer roller 3 for stirring developing agent 2 (toner and carrier), a developer roller 6 for applying the developing agent 2 onto the photoreceptor 4, a doctor blade 7 for adjusting the amount of developing agent 2 to be attached to the photoreceptor 4 and a toner concentration sensor 8 for detecting the toner concentration in the developing agent 2. As shown both in FIGS. 1 and 2, the developer roller 6 is comprised of a magnet structure 11 composed of ferrite magnets with 3–5 poles 9 and a cylindrical support rod 10, a magnet supporting shaft 11*a* for supporting this magnet structure a sleeve 12 which movably engage externally around the magnet structure 11 and a sleeve shaft 12*a* for supporting the sleeve 12. The magnet structure 11 is affixed through its supporting shaft 11*a* to the developing tank 1. When this developing device A is in operation, the sleeve 12 is caused to rotate and the amount of developing agent 2 attached to the sleeve 12 by the force of the magnet 9 is controlled by the doctor blade 7. In FIG. 2, numeral 13 indicates a bearing for supporting the sleeve 12 rotatably by the developing tank 1, numeral 14 indicates driving means for rotating the sleeve 12, numeral 15 indicates its driver motor and numeral 16 indicates a gear for communicating the driving power of this driver motor 15 to the sleeve shaft 12*a*. In FIG. 1, numeral indicates a toner supply roller disposed above the developing tank 1 for rotating in response to a signal from the toner concentration sensor 8 to supply toner 2*a* from a toner box 18 into the developing tank 1.

Of the developing device A described above, the sleeve 12 is an expensive component but since it covers the entire circumference of the magnet structure 11 as shown in FIG. 1, its required area is large and hence increases the cost of the development device A as a whole.

SUMMARY OF THE INVENTION

It is therefore an object of the present invention to provide a developing device for a copier which can be inexpensively produced.

It is another object of the present invention to provide such a developing device which can also prevent the useful lifetime of the magnet structure from being reduced.

It is still another object of the present invention to provide such a developing device of which the torque required for rotating the developer roller when developing agent is scraped therefrom can be reduced.

It is still another object of the present invention to provide such a developing device with which fine image adjustments can be easily effected and from which an image of good quality can be obtained reliably.

It is still another object of the present invention to provide such a developing device with which quick deterioration of developing agent can be prevented.

Developing devices embodying the present invention, as will be described in detail below, are not only comprised of a developer roller having a supporting shaft which is rotatably supported by a developing tank but also characterized as having a magnet structure with a plurality of N and S magnet poles affixed to this shaft, a rotary driver means provided for rotating this shaft to which the magnet structure is affixed and an arcuate member which is hereinafter referred to as a brush forming plate and is disposed between the developer roller and the photoreceptor. One edge of this brush forming plate which is hereinafter referred to as a scraping edge is so formed that the magnetic brush formed on the surface of the magnet structure by the magnetic force of its poles can be scraped and transferred onto the surface of the brush forming plate.

According to the present invention, in summary, the magnet structure which is held stationary in prior art developing devices is caused to rotate around its shaft such that developing agent particles which form a brush on its surface by the magnetic force of its poles are moved with the rotation of the magnet structure. When the brush thus formed comes to the scraping edge of the brush forming plate which takes the place of a prior art sleeve, it is scraped off the surface of the magnet structure by the scraping edge but keeps the form of a brush by the magnetic force of the magnet structure which continues to rotate. As the developing agent thus forming a brush on the surface of the brush forming plate comes into contact with the photoreceptor, it is transferred onto the electrostatic latent image formed on the surface of the photoreceptor to form a toner image. In summary, a developing device according to the present invention uses an arcuate piece of brush forming plate instead of a sleeve which completely envelopes the magnet structure. The cost of the developer roller, which occupies a large portion of the total cost of a developing device, can be thereby reduced and hence the total cost of the developing device can also be significantly reduced.

If the cylindrical surface of the magnet structure is covered by a protective film, it can be prevented from directly contacting the scraping edge and its useful lifetime can be improved. If a member hereinafter referred to as a limiting member is placed near the surface of the magnet structure such that the amount of developing agent traveling with the revolving surface of the magnet structure becomes limited before it reaches the scraping edge, the torque required to rotate the developer roller can be reduced and the useful lifetime of the driver motor can be improved. Alternatively a thin cylindrical rod of a non-magnetic material (hereinafter referred to as a prescraper) may be provided near the scraping edge such that its separation from the external surface of the magnet structure is greater than the separation between the magnet structure and the scraping edge. With a prescraper thus provided, those of the developing agent particles not strongly attracted by the magnetic force of the magnet structure are once separated from the magnet structure but since the prescraper is disposed close to the scraping edge, they stay in the form of a brush and move towards the brush forming plate. Those particles strongly attracted by the magnetic force, on the other hand, pass between the prescraper and the surface of the magnet structure and then scraped by the scraping edge to be moved towards the brush forming section on the brush forming plate because the scraping edge is set closer to the surface of the magnet structure than the prescraper is. The torque required to rotate the developer roller can also be reduced by this design because the incoming developing agent is separated in steps by the prescraper and then by the scraping edge.

If the separation between the brush forming plate and the outer peripheral surface of the magnet structure is made variable, the amount of developing agent attached on the brush forming plate and hence the resistance of the developing agent can be varied to adjust the image quality. If the brush forming plate is rotatably supported around an axis which is not coaxial with the shaft of the developer roller, both the separation of the brush forming section of the brush forming plate from the doctor blade and that from the surface of the magnet structure can be varied simultaneously for the convenience of fine adjustments o image quality. If magnetic powder is uniformly spread over the brush forming plate, this has the effect of uniformly distributing the magnetic field of the magnet structure and fluctuations in the developing pressure of the developing agent caused by differences in the magnetic force of the magnet structure in the radial direction can be corrected. Alternatively, the brush forming section may be formed coaxially with the cylindrical surface of the magnet structure and maintained in such relationship by means of a holder such that the separation therebetween can remain constant and that the amount of developing agent attached to the brush forming plate is stabilized.

In order to prevent the developing agent from getting stuck in the space between the surface of the magnet structure and the brush forming plate, the edge of the brush forming plate distal from the aforementioned scraping edge may be separated farther from the magnet structure. Alternatively, the scraping edge may be formed with an elastic material such as synthetic rubber and allowed to touch the surface of the magnet structure. Such an elastic edge can freely expand or contract in the radial direction of the magnet structure and does not impede its rotary motion while preventing the occurrence of a "locked" situation of the magnet structure whereby the developing agent getting stuck in the space effectively prevents the rotation of the developer roller. Extra magnet pieces may be provided for removing used developing agent particles from the surface of the magnet structure such that they can freely circulate inside the developing tank and become stirred. This has the advantageous effect of preventing deterioration of the developing agent.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 19 is a partially broken diagonal view of a portion of the developing device of FIGS. 17 and 18, FIG. 20 is a sectional front view of a portion of a brush forming plate embodying the present invention, and FIGS. 21, 22, 23 and 24 are sectional front views of portions of still other developing devices embodying the present invention.

In all these figures, components which are identical or substantially similar are indicated by the same numerals.

DETAILED DESCRIPTION OF THE INVENTION

Figures 3, 5:
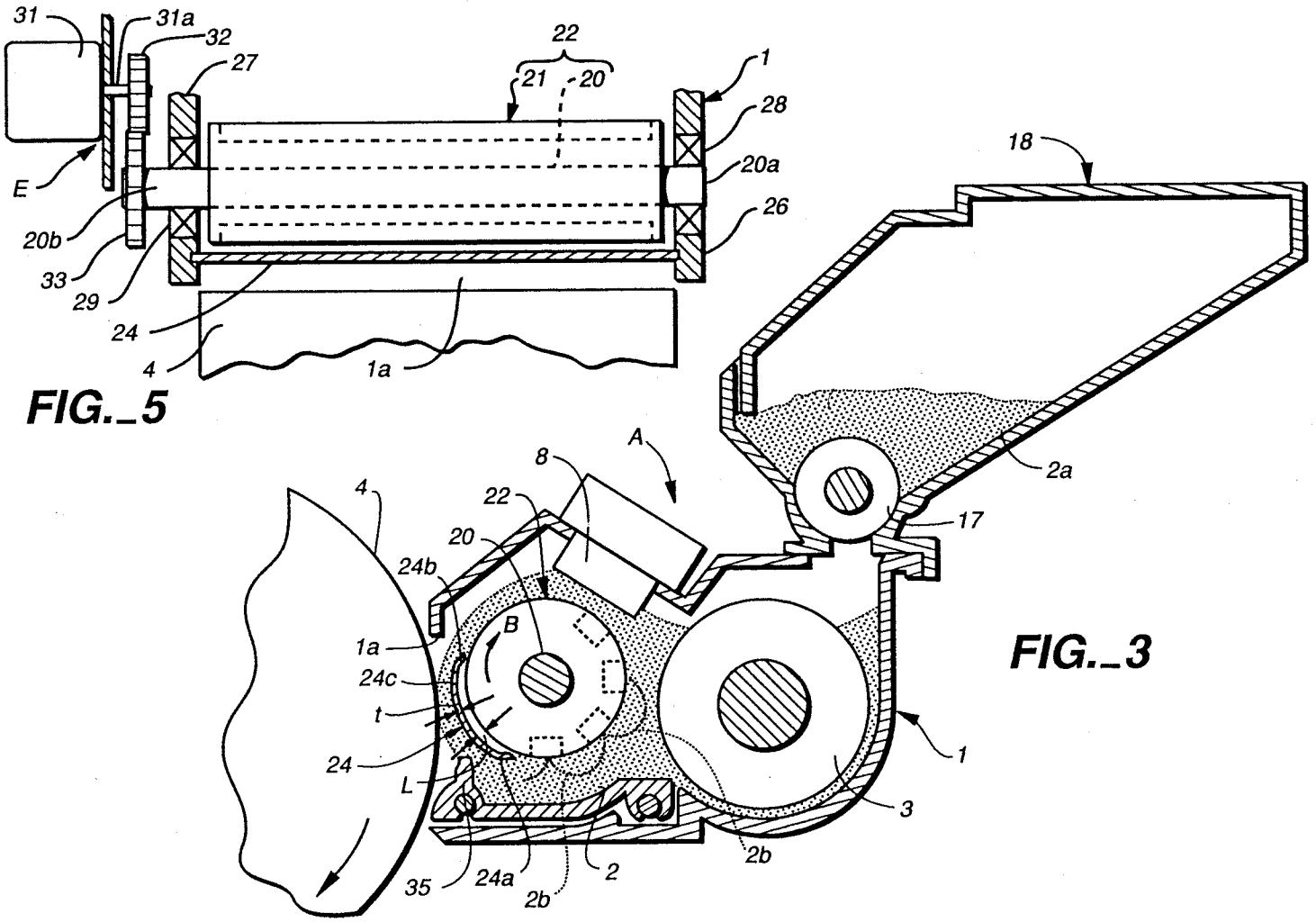
FIG. 3 is a sectional front view of a developing device for a copier embodying the present invention.
FIG. 5 is a sectional plan view of a portion of the developing device of FIG. 1 including its developer roller.
Figure 4:
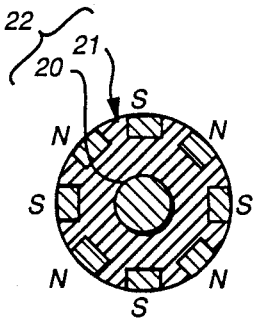
FIG. 4 is a front view of the developer roller of the developing device of FIG. 3.

As shown in FIG. 3, a developing device embodying the present invention comprises a developing tank 1 provided with a developer roller 22 and is characterized in that this developer roller 22 is comprised of a supporting shaft 20 which is rotatably supported by the developing tank and a magnet structure 21 rigidly engaging the supporting shaft 20 internally and having a plurality of N and S magnet poles on its external surface. As shown in FIG. 4 more in detail, the magnet structure 21 includes a cylindrical supporting rod 25 which supports eight magnet poles on its external periphery at equal angular intervals of 45°, N and S poles being arranged alternately.

The developer roller 22 is disposed near an opening 1*a* of the developing tank 1 near the photoreceptor 4. As shown in FIG. 5, its supporting shaft 20 is rotatably supported by the front and back walls 26 and 27 of the developing tank 1 at its end sections 20*a* and 20*b* through bearings 28 and 29. The developer roller 22 is caused to rotate in the direction shown by the arrow B shown in FIG. 3. As shown in FIG. 5, its driving means E includes a driver motor 31, a motor gear 32 attached to the drive shaft 31*a* of the motor 31 and a shaft gear 33 affixed to the supporting shaft 20 near its rear end 20*b* and engaging with the motor gear 32. Between the developer roller 22 and the photoreceptor 4 is a brush forming plate 24 which is an arcuate plate disposed close to the surface of developer roller 22.

One edge of the brush forming plate 24 identified as its scraping edge 24*a* is so formed that a brush formed of developing agent by the magnetic force of the magnet structure 21 can be thereby scraped off the surface of the developer roller 22 and transferred onto its surface.

Figure 1:
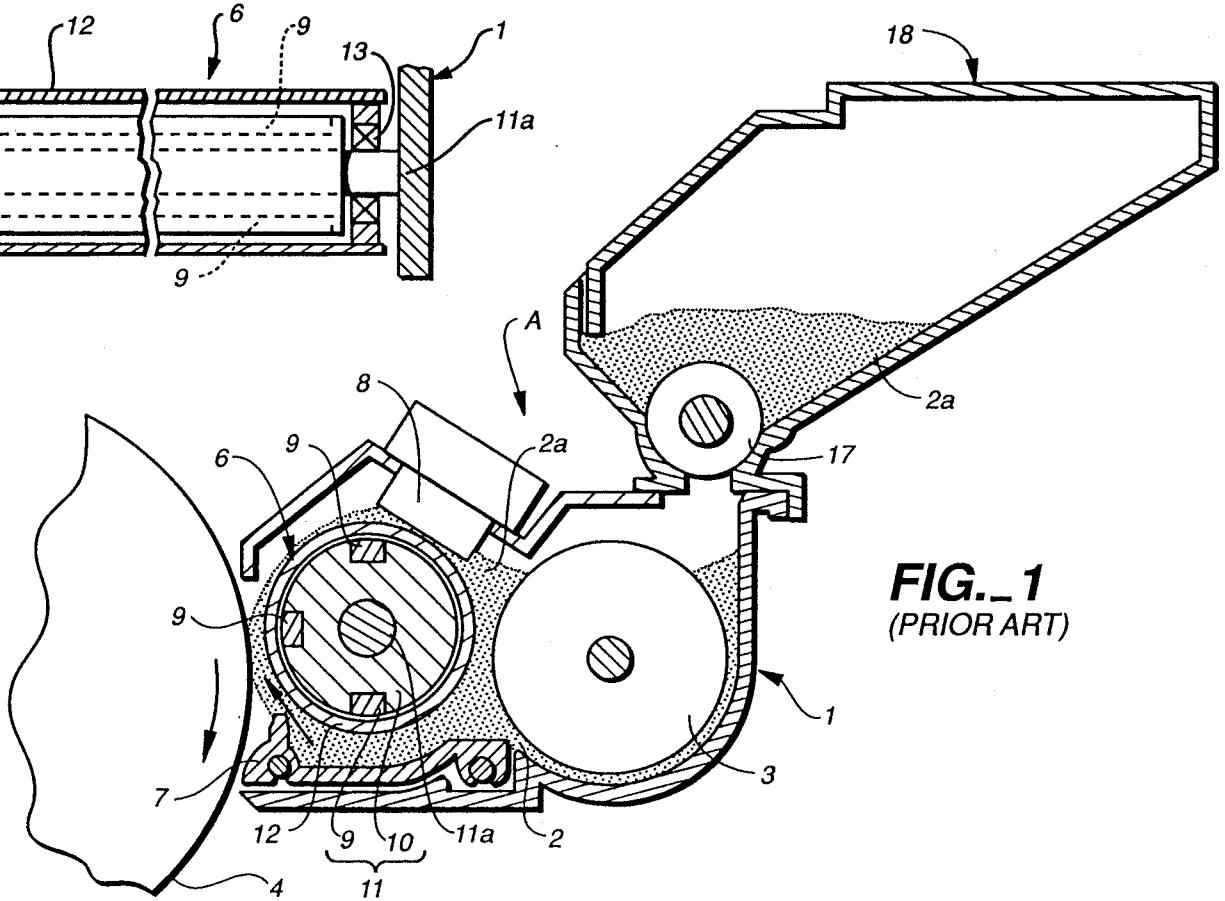
FIG. 1 (PRIOR ART)
FIG. 1 is a sectional front view of a prior art developing device for a copier.
Figure 2:
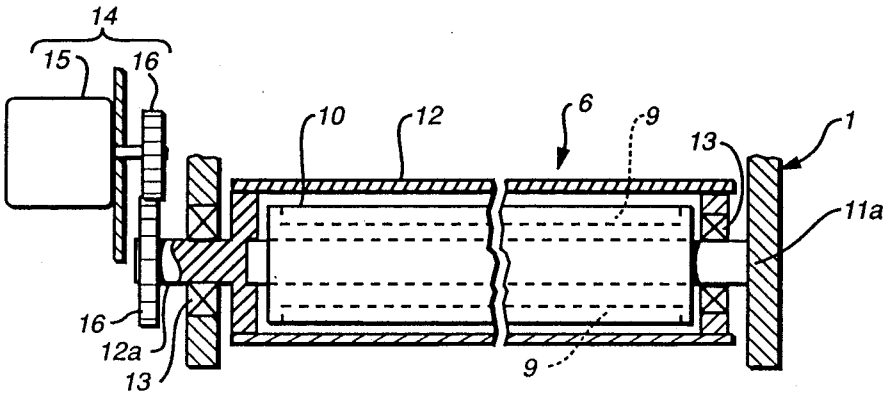
FIG. 2 (PRIOR ART)
FIG. 2 is a sectional plan view of a portion of the developing device of FIG. 1 including its developer roller.

The brush forming plate 24 is made of a non-magnetic electroconductive material such as aluminum or stainless steel and approximately of the same length as the opening 1*a* of the developing tank 1 opposite to the photoreceptor 4. The edge of the brush forming plate 24 distal from the scraping edge 24*a* will be referred to as its back edge 24*b* for reference. A convex arcuate external surface of the brush forming plate 24 where developing agent particles forming a brush is transferred onto is likewise referred to as its brush forming section 24*c*. The thickness of the brush forming plate 24 is t and the brush forming section 24*c* is arcuate coaxially with the cylindrical external surface of the magnet structure 21, separated therefrom by a distance L such that the magnetic force of the N and S magnet poles is still effective. Both the scraping edge 24*a* and the back edge 24*b* of the brush forming plate 24 are formed at sharp angles and sloped towards the external peripheral surface of the developer roller 22, reaching points very close thereto such that developing agent particles attached thereon can be easily scraped thereof by the scraping edge 24*a* and those on the brush forming section 24*c* can be easily discharged onto the surface of the developer roller 22. As shown in FIG. 5, the brush forming plate 24 is attached to the front and back walls 26 and 27 of the developing tank 1. In FIG. 3, numeral 35 indicates a doctor blade for controlling the amount of developing agent 2 to be transferred onto the photoreceptor 4. The doctor blade 35 is disposed on the side of the photoreceptor 4 downstream from the scraping edge 24*a* along the direction of rotation of the developer roller 22. In other respects, the developing device A shown in FIGS. 3 and 5 is identical to the prior art developing device shown in FIGS. 1 and 2.

The developing device A described above by way of FIGS. 3, 4 and 5 functions as follows. As the driver motor 31 starts to rotate, its motion is communicated to the supporting shaft 20 of the developer roller 22 through the gears 32 and 33 engaged mutually as shown in FIG. 5. As the magnet structure 21 is thereby caused to rotate, the developing agent 2, which is already stirred by the rotation of the stirrer roller 3 and electrostatically charged, gathers along the magnetic field lines of the magnet structure 21 and forms a brush 2*b*. As the developer roller 22 moves in the clockwise direction indicated by the arrow B in FIG. 3, the magnetic brush 2*b* also moves along and when it comes to the position of the scraping edge 24*a* of the brush forming plate 24, it is scraped off the surface of the magnet structure 21 but remains as a brush by the magnetic force of the magnet structure 21. As the developing agent 2 is further transported in the direction of the arrow B together with the rotation of the developer roller 22, the amount of the developing agent to be attached to the brush forming section 24*c* is limited by the doctor blade 35. When the developing agent 2 thus limited by the doctor blade 35 comes into contact with the photoreceptor 4, it becomes transferred onto the electrostatic latent image on the surface of the photoreceptor 4 to form a visible toner image. For the purpose of this transfer, a bias voltage is applied to the brush forming plate 24 with respect to the photoreceptor 4. The portion of the developing agent 2 not transferred from the brush forming section 24*c* to the photoreceptor 4 is thereafter transported towards the stirrer roller 3 by the rotation of the developer roller 22 and is stirred again inside the developing tank 1.

Figure 6:
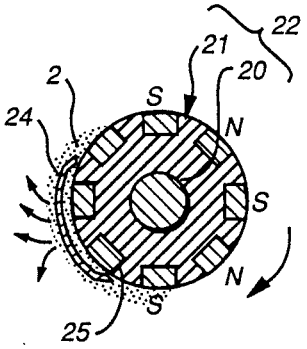
FIGS. 6 and 7 are sectional front views of the developer roller and brush forming plate in use when too much or too little developing agent is attached to the developer roller, respectively.
Figure 7:
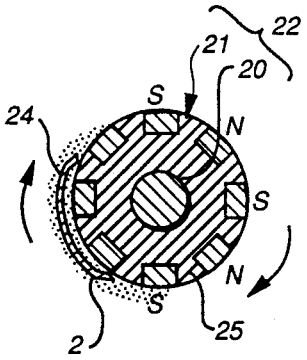

The amount of developing agent 2 attached to the developer roller 22 affects its transfer from the brush forming section 24*c*. If too much developing agent is attached, the magnetic force of the magnet structure 21 cannot easily be effective. As a result, the direction of the brush formed of the developing agent 2 does change with the motion of the magnet structure 21 as shown in FIG. 6 but the motion on the brush forming plate 24 is small. If the amount of developing agent attached to the developer roller 22 is less than adequate, on the other hand, the magnetic force of the magnet structure 21 can easily reach the entire developing agent and, as shown in FIG. 7, the developing agent 2 moves on the brush forming plate 24 in the same direction of motion as the magnet poles. If the diameter of the developer roller 22 is 25 mm, the magnetic force is 700 gauss and the thickness of the brush forming plate 24 is 1.0 mm, the amount of developing agent attached to the brush forming plate 24 becomes about 1–2 mm and this is the normal amount.

Figure 8:
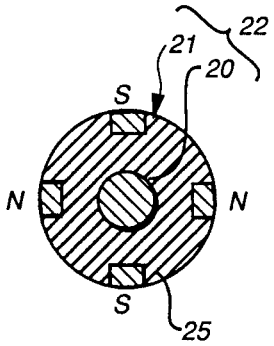
FIG. 8 is a front view of another developer roller embodying the present invention.

The foregoing description of one embodiment of the present invention makes it clear that the sleeve commonly used in a prior art developing device can be dispensed with as well as a flange therefore without sacrificing the quality of developed images. The present invention, however, is not limited by this embodiment and many modifications may be made within the scope of the present invention. For example, the magnet poles may be distributed in the developer roller 22 as shown in FIG. 8 at angular intervals of 90°. With the number of magnet poles thus reduced, the cost of the developing device can be further reduced. Even with a smaller number of magnet poles, a brush of developing agent can be effectively formed by increasing the rotational velocity of the developer roller 22.

Figure 9:
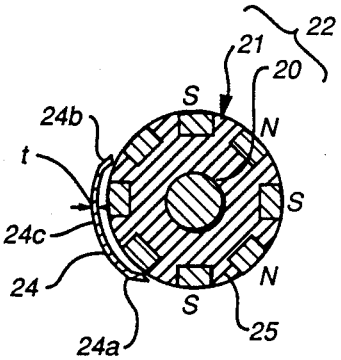
FIG. 9 is a front sectional view of a portion of still another developing device embodying the present invention.

FIG. 9 shows still another embodiment of the present invention characterized as having its brush forming plate 24 so formed as to be thick at the center (maximum thickness shown by t) and to gradually become thinner towards the edges 24*a* and 24*b*. If the maximum thickness t is so selected as not to have any adverse effects on the formation of a brush, images of good quality can be obtained also with a brush forming plate thus formed. Alternatively, the brush forming plate may have a polygonal sectional shape.

Figure 12:
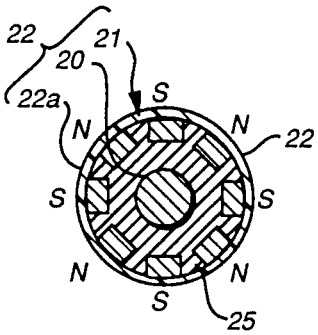
FIG. 12 is a front view of the developer roller of the developing device of FIGS. 10 and 11, FIGS. 13, 14 and 15 are sectional front views of portions of still other developing devices embodying the present invention.
Figure 10:
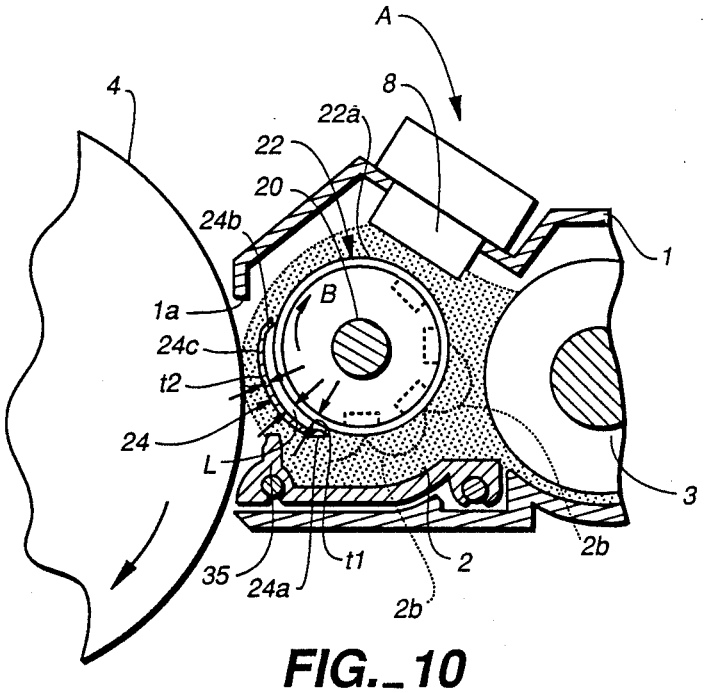
FIG. 10 is a sectional front view of a portion of still another developing device embodying the present invention characterized as having its magnet structure covered by a protective film.
Figure 11:
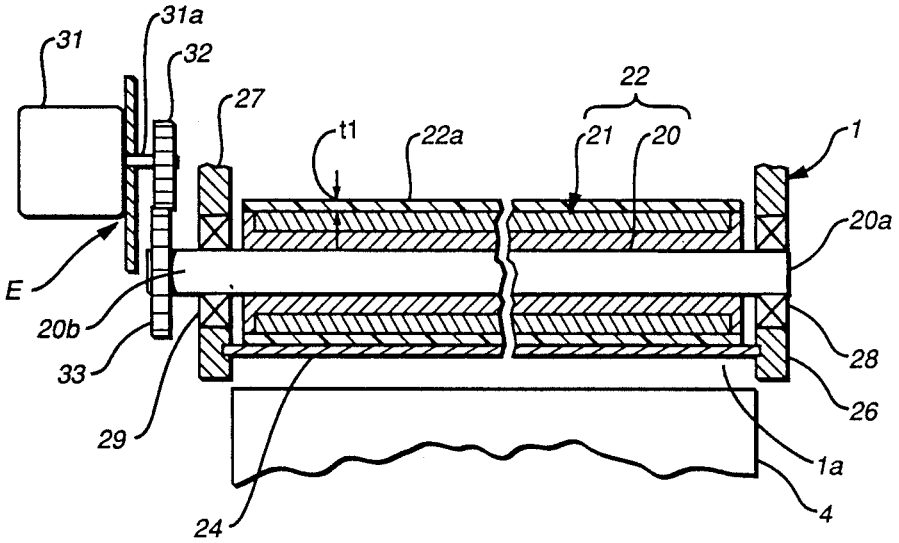
FIG. 11 is a sectional plan view of a portion of the developing device of FIG. 10.

FIGS. 10, 11 and 12 show portions of still another developing device embodying the present invention characterized as having the cylindrical external surface of its magnet structure 21 completely covered by a protective film 22*a*. This protective film 22*a* is formed directly in contact with the external peripheral surface of the magnet structure 21. A non-magnetic material such as polyethylene terephthalate (PET resin) may be used and the external surface of the film 22*a* is made smooth. The thickness $t_1$ of the film 22*a* is limited such that the magnetic force of the magnet structure 21 is effective on the surface. The brush forming plate 24 is of thickness $t_2$ and its brush forming section 24*c* is coaxial with the outer cylindrical surface of the protective film 22a, separated therefrom by a distance L such that the magnetic force of the magnet structure 21 is effective on the surface of the brush forming section 24c. The scraping edge 24a and the back edge 24b of the brush forming plate 24 are in contact with the protective film 22a such that developing agent can easily get on and off from the brush forming plate 24. The advantages of having a protective film thus formed include that abrasion of the magnet structure 21 can be prevented and that deterioration of the developing agent 2 can be the protective film 22a can be nearly entirely scraped off and can be transported towards the stirrer roller 3 to be stirred and charged again.

Figure 13:
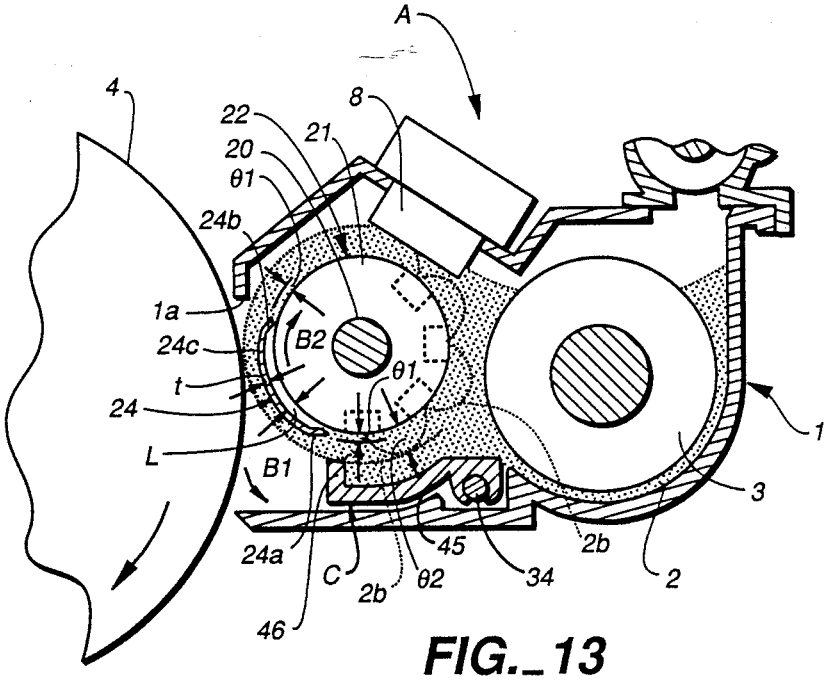

FIG. 13 shows a portion of still another developing device embodying the present invention characterized by a differently shaped limiting member C comprised of a guiding plate 45 for guiding the stirred developing agent 2 from the stirrer roller 3 to the magnet structure 21 and a limiting plate 46 formed protrudingly from this guiding plate 45 towards the developer roller 22. One end of the guiding plate 45 distal from the limiting plate 46 is adjustably affixed around a holder rod 34 such that the separation $\theta_2$ (normally about 1 mm, greater than the separation $\theta_1$ of about 0.05–0.1 mm of the scraping edge 24a and the back edge 24b from the peripheral surface of the developer roller 22) between the tip of the limiting plate 46 and the surface of the magnet structure 21 can be finely adjusted. As shown in FIG. 13, the limiting plate 46 is unistructurally formed with the guiding plate 45. The limiting plate 46 is substantially of the same length as the magnet structure 21 in the direction from the front wall to the back wall of the developing tank 1 and is disposed below the scraping edge 24a so as to be on that side thereof indicated by the arrow $B_1$ pointing opposite to the arrow $B_2$ indicating the direction of rotation of the developer roller 22.

As the developer roller 22 rotates in the direction of the arrow $B_2$, the brush of developing agent formed on its surface is first limited by the limiting plate 46 of the limiting member C. As the developer roller 22 further rotates, the portion of the brush remaining on the developer roller 22 is nearly entirely scraped off by the scraping edge 24a and transported onto the brush forming section 24c by the magnetic force of the magnet structure 21 which moves with the rotation of the developer roller 22. In summary, the brush of developing agent formed on the developer roller 22 is initially reduced in size by the limiting plate 46 before coming to the scraping edge 24a. As a result, the developer roller 22 has less developing agent to carry along on its surface and the torque required to rotate it is reduced. This has the favorable effect of improving the useful lifetime of the driver motor 31 therefore shown in FIG. 5. Ill effects of incorrect amount of developing agent attached on the brush forming plate 24 have been discussed above by way of FIGS. 8 and 9. The holder screw 34 is therefore to be rotated to adjust the relative position of the limiting plate 46, or the separation thereof $\theta_2$ from the surface of the developer roller 22. Although the limiting plate 46 was shown in FIG. 13 as protruding perpendicularly from the guiding plate 45, this is not intended to limit the scope of the invention. The angle of protrusion, for example, may be acute.

Figure 14:
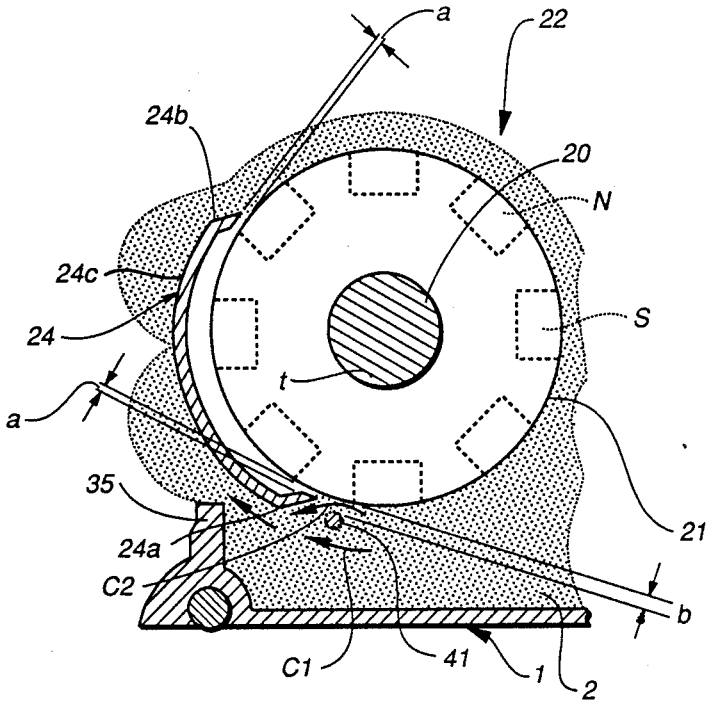

FIG. 14 shows a portion of still another developing device embodying the present invention characterized as having a small rod of a non-magnetic material identified as a prescraper 41 supported by the front and back walls 26 and 27 of the developing tank 1 near the surface of the developer roller 22 and the scraping edge 24a such that its separation b approximately equal to 0.5 mm from the outer surface of the developer roller 22 is greater than the separation a of approximately 0.05–0.1 mm between the scraping edge 24a and the developer roller 22. The purpose of this prescraper 41 is to separate the brush of developing agent transported with the moving surface of the developer roller 22 is cut into two parts such that the torque required to rotate the developer roller 22 is reduced and the useful lifetime of its driver motor 31 ca be improved.

With a prescraper 41 thus provided, those of the developing agent particles only weakly attached in the brush formed on the surface of the developer roller 22 are temporarily separated therefrom but since the prescraper 41 is placed very close thereto, they remain in the form of a brush and moved towards the brush forming plate 24 along the arrow $C_1$ on the distal side of the prescraper 41 away from the developer roller 22. In the meantime, those of the developing agent particles not separated from the developer roller 22 by the prescraper 41 pass between the prescraper 41 and the developer roller 22 but are mostly scraped by the scraping edge 24a as shown by the arrow $C_2$ to move towards the brush forming section 24c. This can happen because the separation b is greater than the separation a as explained above. In summary, the prescraper 41 serves to separate the brush of developing agent particles to be divided into two parts as they are transported onto the brush forming section 24c. As a result, the torque required to rotate the developer roller 22 is reduced.

Figure 15:
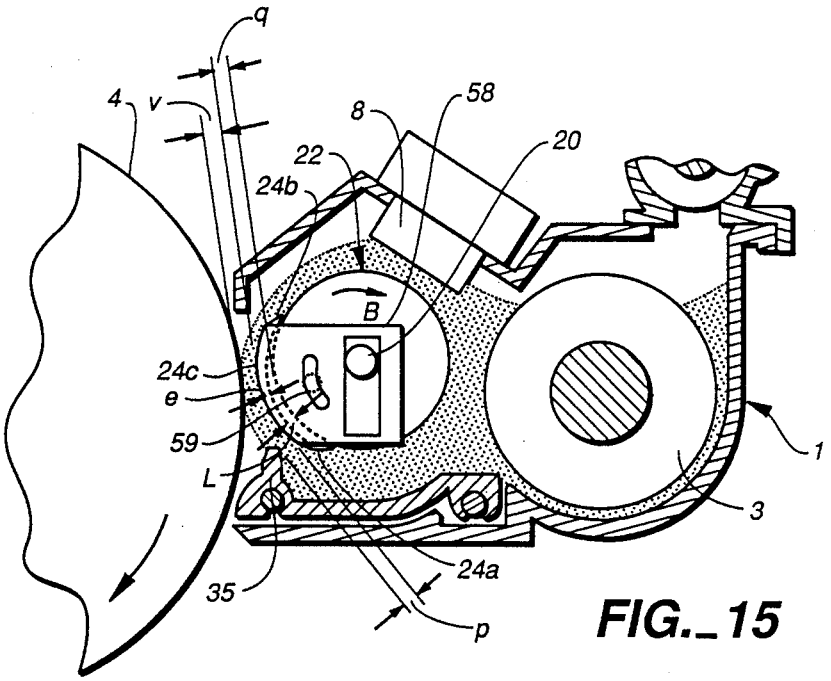
Figure 16:
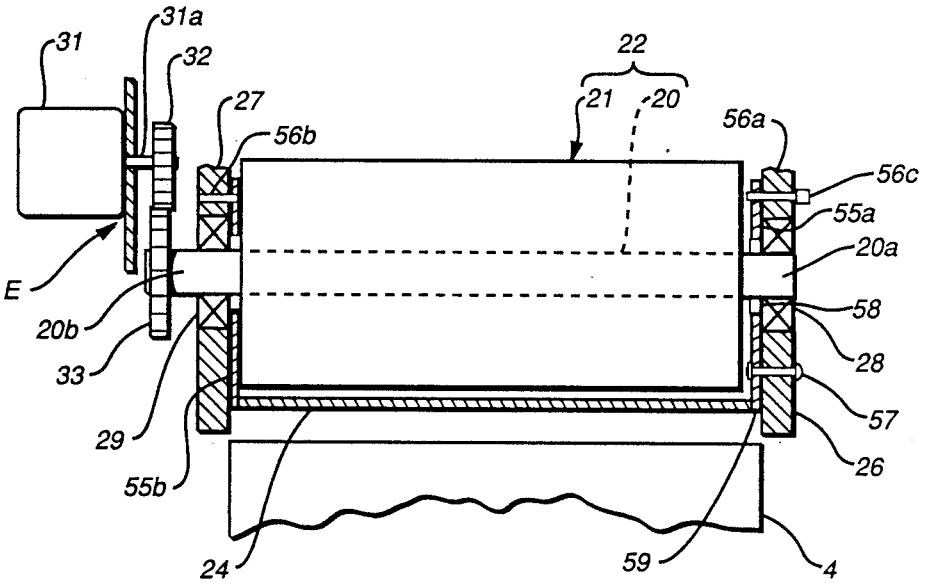
FIG. 16 is a sectional plan view of a portion of the developing device of FIG. 15.

FIGS. 15 and 16 show portions of still another developing device embodying the present inVention characterized as having its brush forming plate 24 supported not rigidly by the walls of the developing tank 1 but by rotatable supporting plates 55a and 55b such that the separations p, q and r of the brush forming section 24c respectively from the doctor blade 35, the magnet structure 21 and the photoreceptor 4 can be simultaneously varied and fine adjustments of the image quality can be thereby effected. The brush forming plate 24 is normally supported by the rotatable supporting plates 55a and 55b from the front and back such that its brush forming section 24c is separated from the peripheral surface of the developer roller 22 by e which varies gradually to the maximum distance L near its scraping edge 24a. These supporting plates 55a and 55b are rotatably supported by the developing tank 1 around mutually coaxial shafts 56a and 56b. A knob 56c is penetratingly affixed to the front one of these shafts 56a for rotating these supporting plates 55a and 55b and a screw 57 which penetrates the front wall 26 of the developing tank 1 for fastening the supporting plates 55a and 55b as shown in FIG. 16. Since the shafts 56a and 56b are not coaxial with the supporting shaft 20 of the developer roller 22, the aforementioned separation e can be freely varied. The rotatable supporting plates 55a and 55b are provided with openings 58 for allowing the supporting shaft 20 of the developer roller 22 to pass through and an arcuately elongated opening 59 through which the screw 57 penetrates. The rotatable supporting plates 55a and 55b are rotatable around the shafts 56a and 56b and their angular positions can be set by tightening the screw 57.

When it is desired to change the image quality by varying the amount of developing agent 2 attached to the brush forming plate 24, the screw 57 is loosened and the knob 55c is turned in the desired direction to change the angular position of the supporting plates 55a and 55b. The brush forming plate 24 can thus be set at a new position with respect to the developing tank 1 and the screw 57 is tightened again. By adjusting the separation p between the doctor blade 35 and the brush forming section 24c, the amount of developing agent flowing onto the brush forming plate 24 can be controlled. The separation q between the magnet structure 21 and the brush forming section 24c controls the magnetic force experienced by the carrier of the developing agent to affect the image quality. The separation r between the photoreceptor 4 and the brush forming section 24c controls the thickness of the developing agent 2 which contributes to the development and thereby affects the resistance of the developing agent 2 between the photoreceptor 4 and the brush forming plate 24 and hence also the quality of the image.

Alternatively to the above, the brush forming plate 24 may be made rotatable around an axis in coaxial relationship with the supporting shaft 20 of the developer roller 22. If the curvature of its brush forming section 24c is varied gradually, the separations p, q and r can be effectively controlled simultaneously by adjustingly rotating the brush forming plate 24 around its supporting shaft.

Figure 17:
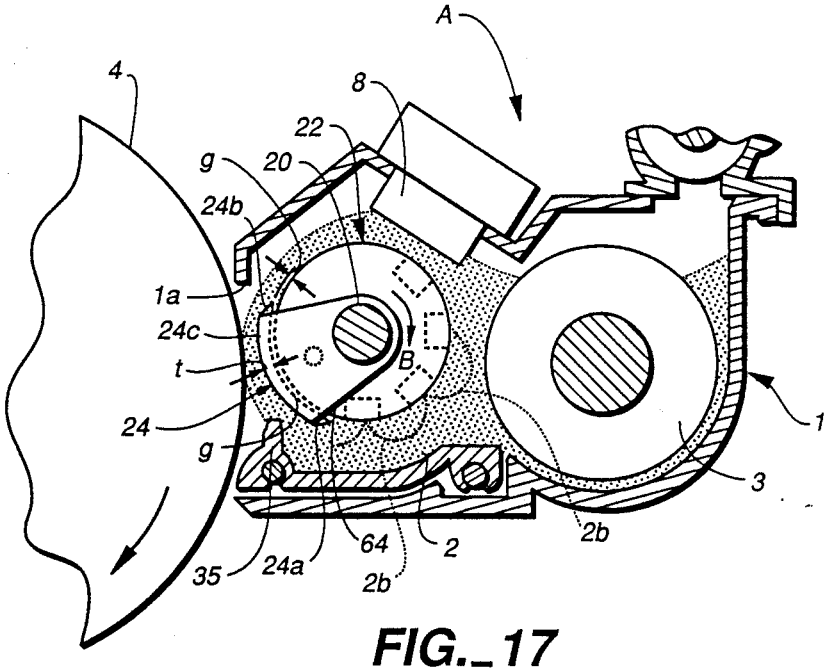
FIG. 17 is a sectional front view of a portion of still another developing device embodying the present invention.
Figure 18:
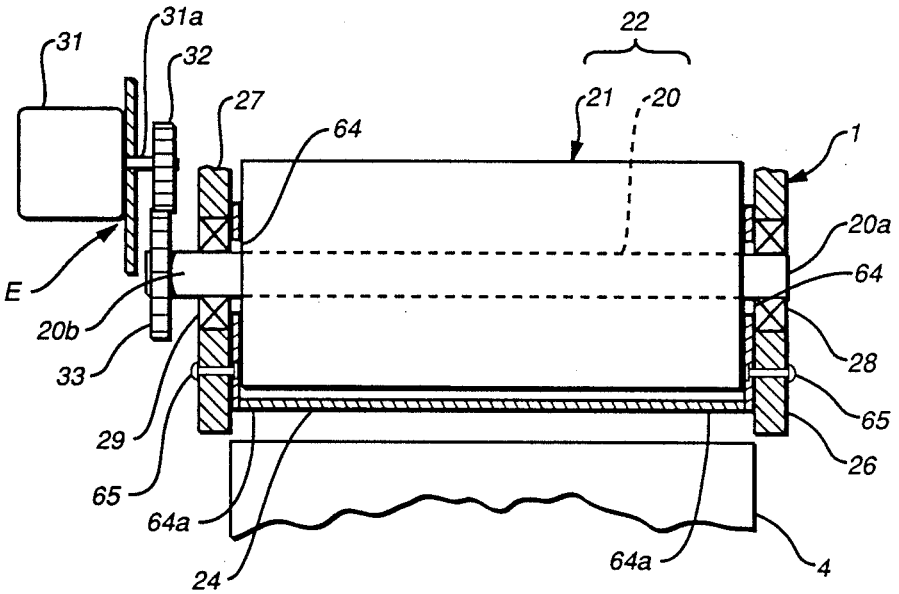
FIG. 18 is a sectional plan view of a portion of the developing device of FIG. 17.

FIGS. 17, 18 and 19 show portions of still another developing device embodying the present invention characterized as having its brush forming plate 24 of a uniform thickness t rotatably supported by front and back holding plates 64 of a non-magnetic material around the supporting shaft 20 of the developer roller 22 such that a small constant separation g between the developer roller 22 and the brush forming plate 24 can be maintained. In FIGS. 18 and 19, numerals 64 indicate screws for affixing the holding plates 64 to the front and back walls 26 and 27 of the developing tank 1. These holding plates 64 are fan-shaped and disposed between the front and back end surfaces of the magnet structure 21 and the front and back walls 26 and 27 of the developing tank 1. The peripheral edges 64a of the holding plates 64 are cut in a circular shape to match the curvature of the brush forming plate 24 to which they are attached. With the help of such holding plate 64, the separation (t+g) between the peripheral surface of the developer roller 22 and the brush forming section 24c remains constant and this has the effect stabilizing the rate of flow of developing agent on the brush forming section 24c.

FIG. 20 shows a detailed structure of a brush forming plate 24 according to another embodiment of the present invention. In the above, the brush forming plate 24 was described as being comprised of a non-magnetic electroconductive material. According to another embodiment of the present invention shown in detail in FIG. 20, the brush forming plate 24 is composed of an external layer 124a and an internal layer 124b. The external layer 124a is on the side of the photoreceptor 4 and comprises a non-magnetic electroconductive material such as aluminum or stainless steel. The internal layer 124b is on the side of the magnet structure 21 and comprises a resin material containing magnetic powder 124d uniformly dispersed therethrough. The internal layer 124b with magnetic powder 124d dispersed therethrough has the effect of diffusing the magnetic field of the magnet structure 21 such that fluctuations in the developing pressure in the radial direction of the magnet structure 21 can be corrected uniformly. As a result, the developing agent 2 contacts the exposed areas of the photoreceptor 4 uniformly and fluctuations in development can be prevented. If the rotational velocity of the magnet structure 21 is increased, this also has the effect of uniformizing the developing pressure and to further improve the quality of the produced image. Alternatively to the structure shown in FIG. 20, the resinous internal layer 124b may be dispensed with and powder of a magnetic material may be scattered uniformly and directly attached on the back surface of the non-magnetic electroconductive layer 124a.

FIG. 21 shows a portion of still another developing device embodying the present invention modified such that the portion of developing agent not scraped up by the scraping edge 24a of the brush forming plate 24 and traveling between the surface of the developer roller 22 and the brush forming plate 24 does not get stuck in this small space to impede the rotation of the developer roller 20 or to cause a so-called "locked" condition whereby the developer roller 22 is completely prevented from rotating. According to the embodiment of the present invention shown in FIG. 21, the brush forming plate 24 is so formed that the separation $f_1$ between the brush forming plate 24 and the surface of the developer roller 22 at the scraping edge 24a is made smaller than the separation $f_2$ at the back edge 24b such that the portion of developing agent not scraped off by the scraping edge 24a and traveling between the brush forming plate 24 and the developer roller 22 has no difficulty passing past the back edge 24b of the brush forming plate 24 towards the stirrer roller 3.

Figure 22:
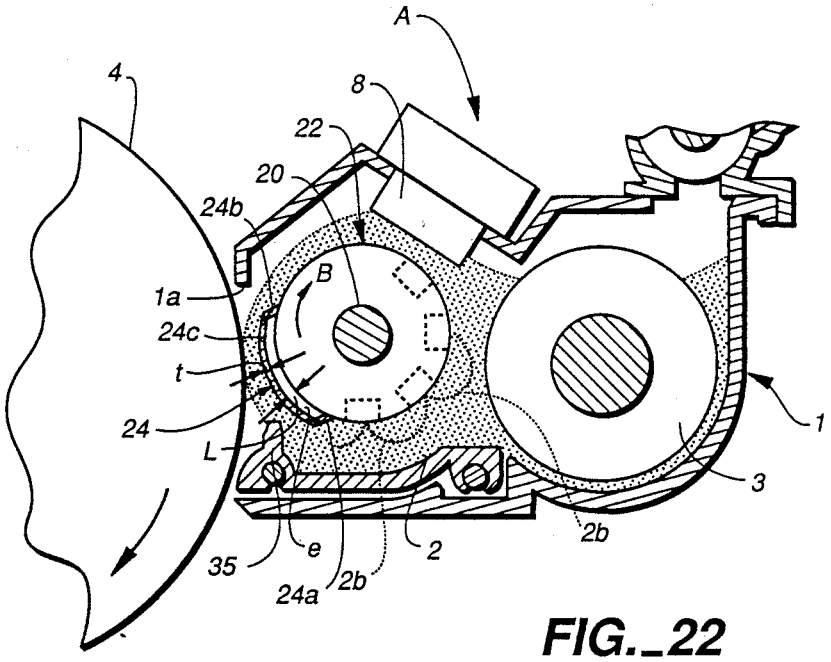

FIG. 22 shows a portion of still another developing device embodying the present invention modified for the same purpose of preventing a locked condition from occurring. The developing device according to this embodiment is characterized as having its scraping edge 24a and the back edge 24b of the brush forming plate 24 further extended towards and in contact with the rotating surface of the developer roller 22 and forming these contacting parts with an elastic material such as synthetic rubber. The symbols e and L are as defined above. In operation, the scraping edge 24a, which is made of an elastic substance, freely stretches and contracts and hence does not impede the rotational motion of the magnet structure 21. Since it thus remains in contact with the surface of the developer roller 22, the developing agent 2 attached to this surface is nearly completely scraped thereof and prevented from entering the space of height e between the rotating surface and the brush forming plate 24.

FIG. 23 shows a portion of still another developing device embodying the present invention modified still for the same purpose as above and characterized as being provided with an arcuate elastic member 66 attached to the brush forming plate 24 and disposed between the developer roller 22 and the brush forming plate 24 such that the inner concave surface of this elastic member 66 is in contact with the surface of the developer roller 22. At the scraping edge 24a and the back edge 24b of the brush forming plate 24, the side edges of this elastic member 66 are so formed as to make continuous slopes with the edges 24a and 24b such that the brush of developing agent transported on the surface of the developer roller 22 can be smoothly scraped off and transported further on towards the brush forming section 24c.

Figure 24:
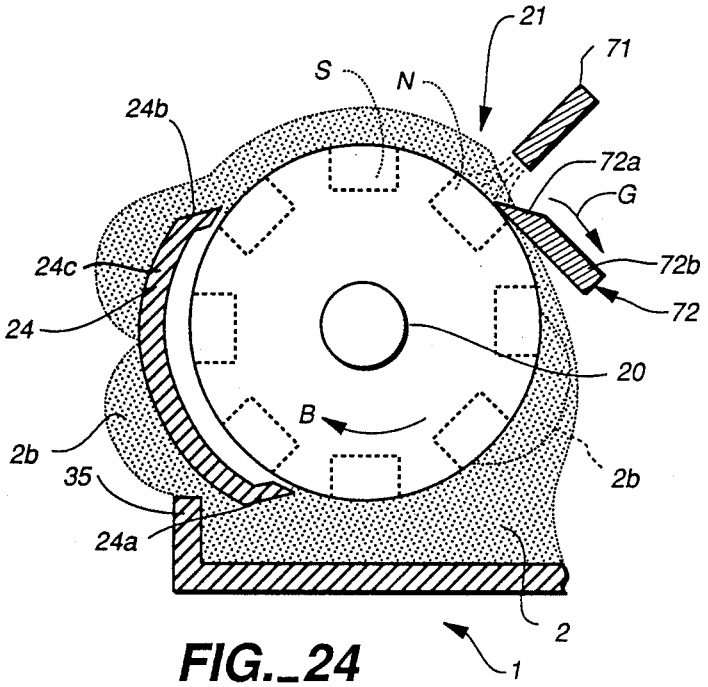

FIG. 24 shows a portion of still another developing device embodying the present invention characterized as having means for causing the used developing agent to be separated from the surface of the developer roller 22 and transported to the stirrer roller 3 reliably so that deterioration of the developing agent can be prevented. The means for this purpose according to the embodiment of the present invention shown in FIG. 24 includes a separator magnet 71 disposed between the back edge 24b of the brush forming plate 24 and the stirrer roller 3 for producing a magnetic field in the radial direction and a separator piece 72 near the separator magnet 71 and nearly in contact with the surface of the developer roller 22. They are both plate-like in form and rigidly affixed to the front and back walls 26 and 27 of the developing tank 1. The separator piece 72 has a sharp separator edge 72a nearly in contact with the surface of the developer roller 22 and a guiding section 72b for guiding towards the stirrer roller 3 the used developing agent 2 separated from the developer roller 22 by the separator edge 72a. By "nearly in contact" is meant a separation of up to 0.1 mm in view of the ill effects of friction and the like to be avoided. The separator magnet 71 has an ordinary rectangular sectional shape.

With separator means provided as described above, the magnetic field between the developer roller 22 and separator magnet 71 becomes nearly straight and radial as shown by broken lines in FIG. 24 such that the developing agent particles are released thereby from their brush-like formation and easily separated from the developer roller 22 by the separator edge 72a of the separator piece 72. The developing agent particles thus separated are thereafter transported along the guiding section 72b of the separator piece 72 as shown by the arrow G towards the stirrer roller 3. In summary, the separator means described above makes it easier for the used developing agent particles to be efficiently returned to the stirrer roller 3 such that deterioration of the developing agent 2 can be reliably prevented.

The present invention has been described above by way of only one example and a limited number of modified embodiments but they are not intended to be limitative. Many of the modifications illustrated individually above can be combined together. Such modifications and combinations of modifications, whether illustrated above or not, which may be apparent to a person skilled in the art are intended to be included within the scope of this invention.

What is claimed is:

1. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate between said developer roller and said photoreceptor, said brush forming plate having at one end thereof, a scraping edge for scraping developing agent attached to said developer roller and transporting said developing agent onto said brush forming plate, said brush forming plate having an outer layer of a non-magnetic electroconductive material and an inner layer having powder of a magnetic material dispersed therethrough.

2. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof a scraping edge for scraping developing agent attached to said developer roller and transporting said developing agent onto said brush forming plate, said brush forming plate having an internally facing surface with powder of a magnetic material dispersed attached thereon.

3. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, said scraping edge comprising an elastic material and being in contact with said external peripheral surface of said magnet structure.

4. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, said brush forming plate having an inner layer which comprises an elastic material and being in contact with said external peripheral surface of said magnet structure.

5. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, and a separating means for separating away from said developer roller a part of developing agent being transported on said developer roller towards said scraping edge.

6. The developing device of claim 5 wherein said separating means includes a thin rod disposed near said scraping edge and said developer roller, the separation of said rod from said developer roller being less than the separation between said scraping edge and said developer roller.

7. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, the separation between said brush forming plate and said external peripheral surface of said magnetic structure being adjustably variable, said developing device further comprising image controlling means for controlling the amount of developing agent attached to said brush forming plate, said image controlling means also serving to adjustingly rotate said brush forming plate around an axis.

8. The developing device of claim 7 wherein said axis is not coaxial with said supporting shaft of said developer roller.

9. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, and removing means for removing used developing agent from said external peripheral surface of said magnet structure, said removing means including a separator magnet for producing a magnetic field substantially normal to said external peripheral surface and a separator piece disposed near said separator magnet and nearly in contact with said magnet structure.

10. The developing device of claim 1 wherein said brush forming plate has a uniform thickness.

11. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, said brush forming plate having thickness gradually decreased from a center part towards edges thereof.

12. A developing device for a copier with a photoreceptor, said developing device comprising a developing tank, a developer roller including a supporting shaft and a magnet structure with an external peripheral surface, said supporting shaft being rotatably supported by said developing tank, said magnet structure being affixed to said supporting shaft and having a plurality of magnet poles on said external peripheral surface thereof, driving means for causing said supporting shaft to rotate, and an arcuate brush forming plate of a non-magnetic electroconductive material between said developer roller and said photoreceptor, said brush forming plate having at one end thereof, a scraping edge for scraping developing agent attached to said developer roller and transporting said developing agent onto said brush forming plate, said brush forming plate having an external surface opposite said photoreceptor, curvature of said external surface changing gradually from a center part towards edges thereof.

* * * * *